United States Patent [19]

Siwersson et al.

[11] 4,217,109

[45] Aug. 12, 1980

[54] COMPOSITION COMPRISING A PULVERIZED PURIFIED SUBSTANCE, WATER AND A DISPERSING AGENT, AND A METHOD FOR PREPARING THE COMPOSITION

[75] Inventors: Olle L. Siwersson, Helsingborg; Arne E. Wall, Landskrona; Jan A. T. Loodberg, Helsingborg, all of Sweden

[73] Assignee: AB Scaniainventor, Helsingborg, Sweden

[21] Appl. No.: 908,497

[22] Filed: May 23, 1978

[30] Foreign Application Priority Data

May 31, 1977 [SE] Sweden ..... 7706315
May 17, 1978 [SE] Sweden ..... 7805632

[51] Int. Cl.[2] ..... C10L 9/10; C10L 1/32

[52] U.S. Cl. ..... 44/1 SR; 44/51; 423/461

[58] Field of Search ..... 44/1 R, 6, 51; 423/461

[56] References Cited

U.S. PATENT DOCUMENTS

| | | | |
|---|---|---|---|
| 2,346,151 | 4/1944 | Burk et al. | 44/51 X |
| 2,359,325 | 10/1944 | McConnell et al. | 44/51 X |
| 3,168,350 | 2/1965 | Phinney et al. | 44/51 X |
| 3,454,363 | 7/1969 | Rieve | 423/461 |
| 3,762,887 | 10/1973 | Clancey et al. | 44/51 |
| 4,076,505 | 2/1978 | Dessau | 44/1 R |
| 4,094,810 | 6/1978 | Thomas | 44/51 X |
| 4,162,044 | 7/1979 | Manfroy et al. | 241/16 |
| 4,162,045 | 7/1979 | Katzer et al. | 241/16 |

*Primary Examiner*—Carl F. Dees
*Attorney, Agent, or Firm*—Beveridge, DeGrandi, Kline & Lunsford

[57] ABSTRACT

A composition consisting of carbon powder, water and a dispersing agent. The particle size of the carbon powder is less than 100 μm, preferably less than 40 μm. The composition is obtained by preparing a mixture of about 1–20% by weight, preferably about 10% by weight, of carbonaceous powder, water and 0.02–4% by weight of dispersing agent. The dispersing agent is selected preferably from polyelectrolytes, such as alkali metal and ammonium salts of polycarboxylic acids, and polyphosphates. These substances possess the property of charging the powder particles of carbon and the impurity particles in a different degree. This different charging is utilized to separate impurity particles from carbon particles, whereupon the purified composition is suitably dehydrated to attain an increased carbon powder concentration of, for instance, 50–80% by weight.

32 Claims, No Drawings

COMPOSITION COMPRISING A PULVERIZED PURIFIED SUBSTANCE, WATER AND A DISPERSING AGENT, AND A METHOD FOR PREPARING THE COMPOSITION

The present invention relates to a composition containing pulverized carbon, water and a dispersing agent, and to a method for preparing such a composition.

The invention relates in particular to a method for preparing from a carbonaceous starting material which, in addition to carbon, also includes impurities, a composition which contains the carbon in as pure a form as possible.

As is well known, mineral coal, for instance, contains, like many other raw materials, impurities which include int.al. organically bound sulphur, various metal sulphides and other metal impurities as well as soil and clay particles. These impurities have a detrimental effect on the environment and, when mineral coal is used as a fuel, it is desirable to avoid discharging the impurities to the environment. Coal firing has previously been effected without any prior cleaning of the coal other than by washing and so, it has been necessary to remove the impurities from the flue gases, which has required large and expensive flue gas purification plants. This has been one of the reasons for the increasing use of oil as a source of energy instead of coal.

Since the combustion of liquid fuels, such as oil, requires combustion devices of a different design as compared with those for combustion of solid fuels, the change-over to oil has made the return to solid fuels more difficult and further weakened the competitive strength of coal with respect to oil.

Since, however, coal and in particular mineral coal constitutes a considerable energy reserve, it is highly desirable to eliminate the above drawbacks so as to give coal enhanced competitive strength with respect to liquid fuels, such as oil.

In order to eliminate the drawbacks of coal as a solid fuel, it has previously been suggested to convert coal into a liquid fuel by finely dividing and dispersing it in suitable carrier liquids, such as water or hydrocarbons. The coal will hereby become easier to handle and the otherwise existing risk of explosion and spontaneous ignition will be eliminated. In addition, environmental inconveniences, such as soiling associated with the handling of solid carbonaceous fuels, will be eliminated.

As an example of prior proposals for converting coal into a liquid state by dispersion in a carrier medium, such as water, may be mentioned Swedish patent application No. 7613478-2. As opposed to the present invention, however, the fuel of this disclosure is subjected to a preparatory hydrothermal treatment in order to remove bound water in the fuel, a conventional surfactant being also added to the treated fuel for dispersion.

Further, British Patent Specification No. 1,469,319 discloses a method for transporting coal in the form of a liquid slurry, and mention is also made in this patent specification of a preparatory heat treatment in order to remove bound water from the coal. It is also stated that conventional surfactants, such as anionic alkylaryl sulphonates, may be added.

Further, U.S. Pat. No. 3,762,887 discloses a liquid fuel consisting of particulate coal and water. According to this patent specification, there is no addition of any dispersing agent.

As disclosed in the art, some of the drawbacks of coal used as a solid fuel are eliminated, but there is no cleaning of the coal raw material. It is however highly important to make efforts to purify the coal material, since one of the main reasons for not using coal to a greater extent as an energy raw material is precisely that it contains so many pollutants that it is unsuitable from the environmental point of view.

According to the present invention, it has been possible to eliminate all of the above-discussed drawbacks of coal as a fuel. Thus, according to the invention, coal is converted to a liquid fuel by dispersion in water, whereby the coal will be easier to handle in respect of transport and storage, and the otherwise existing risk of explosion and spontaneous ignition is eliminated. In addition, the coal raw material is purified whereby the need for expensive and bulky flue gas purification plants will be reduced or fully eliminated and there is obtained a fuel which is environmentally satisfactory.

The object of the present invention is achieved in that, in the dispersion of a carbonaceous starting material which, in addition to carbon, also incorporates impurities, addition is made of a dispersing agent which by selective adsorption brings about different charging of the carbon particles and the impurity particles, and that this different charging is used in order to separate carbon.

According to the invention, there is thus obtained a composition containing pulverized carbon, water and a dispersing agent, the composition being characterized in that the dispersing agent by selective adsorption brings about different charging of carbon particles and particles of other substances.

According to the invention, there is also obtained a method for preparing from a carbonaceous starting material which, in addition to carbon, also contains impurities, a composition which contains the carbon in pulverized purified form, as well as water and a dispersing agent, the method being characterized in that the starting material is mixed with water, pulverized and, in connection with or subsequent to pulverization, supplied with a dispersing agent which by selective adsorption brings about different charging of the carbon particles and the impurity particles, and that this different charging is used in order to separate carbon from impurities.

The invention will be realized particularly appropriately by applying the characteristics that appear from the subclaims.

As examples of preferred kinds of dispersing agents according to the invention, mention may be made of polyelectrolytes and polyphosphates. Conventional surfactants, such as alkylaryl sulphonates, seem, however, to lack the ability of charging carbon particles and impurity particles differently and, thus, such surfactants are not comprised by the invention.

In order to facilitate understanding of the invention, the preparation of a liquid carbon power composition according to the present invention will be described in greater detail below.

Mineral coal of any suitable kind is mixed with water and pulverized to a small particle size. The pulverization is suitably effected by wet grinding, considering both the risk of explosion and energy consumption. In order that the impurities accompanying the carbonaceous material should later be accessible, pulverization should be conducted to a particle size of less than 100 μm, preferably below 50 μm. Further, in order to obtain as stable a dispersion of the coal in the water as possible, the particle size should be less than 40 μm. A particle size of less than 40 μm is also suitable from the point of view of combustion, since the combustion then effected is similar to that of oil. However, it is not suitable to conduct pulverization too far, partly since this requires considerable energy consumption, partly since colloidal particles of a size below 1 μm will render subsequent purification more difficult.

The carbon content of the coal-water mixture is adjusted in connection with the grinding to a value of about 1–20% by weight, suitably about 10% by weight.

In order to disperse the coal in water, addition is made of a dispersing agent. It is true that this dispersing agent may be added after the wet grinding but in order to facilitate the grinding operation it is suitable that the dispersing agent is added in connection with the grinding.

As previously mentioned, the dispersing agent of the invention is capable of charging carbon particles and impurity particles differently and is selected preferably from polyelectrolytes and polyphosphates. Examples of suitable polyelectrolytes are alkali metal and ammonium salts of polycarboxylic acids, such as for instance polyacrylic acid. Particular examples of suitable polyelectrolytes are such dispersing agents as are sold in the form of a 40% aqueous solution under the trade mark DISPEX, such as DISPEX A40 (ammonium salt of polycarboxylic acid), DISPEX N40 (sodium salt of polycarboxylic acid), and DISPEX G40 (sodium salt of polyacrylic acid). Of these agents, DISPEX A40 and G40 have proved especially suitable in connection with the present invention.

The amount of added dispersing agent is dependent upon the particular dispersing agent used. Generally speaking, the content of dispersing agent should be sufficient to bring about as stable a dispersion of the coal as possible. In general, the dispersing agent content should be in the range 0.02–4% by weight, calculated on the water. Here, it should be added that contents below 0.02% by weight will produce a hardly perceptible effect, whereas contents above about 4% by weight are uneconomical. The optimum amount for a particular case may readily be established by anyone skilled in the art.

If the dispersing agent, as above, is added in connection with or subsequent to the pulverization of the coal (i.e. at a carbon content of about 10% by weight), a suitable content of dispersing agent has turned out to be in the range about 0.04–0.4% by weight, preferably about 0.12% by weight.

As previously mentioned, the particular dispersing agents of the present invention possess the property of charging the particles in the coal-water mixture electrically, the carbon particles and the impurity particles being charged in a different degree. In the invention, this property is used in order to separate impurity particles from carbon particles. The separation effect on account of different particle charge may be combined and enhanced with conventional separation methods.

With a view to purifying the coal-water mixture, the diluted mixture is passed onto a sedimentation device, for instance a lamella filter, where the mixture is allowed to settle. In that the carbon particles after charging will have a greater charge than the impurity particles, these latter particles will settle more rapidly than the carbon particles. Hence, the coal-water mixture is purified from the impurity particles.

Moreover, since the carbonaceous material contains magnetic impurities in the form of for instance pyritic sulphur, it is also convenient to effect magnetic separation. This per se known operation may be combined with sedimentation in the form of a pre- or post-treatment step.

By using the above described selective separation technique, it is possible to remove more than half of the sulphur and other impurities. Thus, by using a combination of selective sedimentation and magnetic separation, all of the pyritic sulphur has been removed and the sulphur content lowered from 0.7% to 0.3%.

Instead of the above-defined selective sedimentation, the separation of impurities may be effected by flotation. On account of the lower charge of the impurities as compared with the coal particles, the impurities tend in fact to aggregate to a greater extent and the resultant aggregates may then be subjected to flotation.

Another alternative method for effecting separation between carbon and impurities on account of their different degree of charging is to utilize their different migration rate in an electric field. However, because of the great electric resistance in the liquid, such a separation method requires a relatively large amount of energy.

In conjunction with the above-described dispersion and purification treatment, the purified coal-water mixture is suitably concentrated in that part of the water is removed so as to increase the carbon content of the mixture. If the mixture is to be transported, for instance by pumping in pipelines, a carbon content of about 40% by weight at most is suitable with respect to viscosity. However, if the mixture is to be burnt immediately, the carbon content should be raised to about 50–80% by weight, preferably about 55–70% by weight. If the mixture is to be stored prior to combustion, the carbon content may be further increased, the mixture being then diluted with water prior to combustion to the indicated suitable carbon content.

The water which is removed for increasing the carbon content contains a certain amount of dispersing agent and, for reasons of economy, may suitably be returned to the process as additional water for the wet grinding, optionally after precipitation of dissolved impurities. Discharge of dispersing agent to the environment is hereby avoided at the same time as the addition of fresh dispersing agent is minimized.

As intimated above, the water content of the coal-water mixture can be adjusted, as desired, by removal or addition of water. For storage or transport in bulk, the water content may thus be reduced to a minimum, it being possible thereafter to raise the water content in view of pipeline transport of the mixture or combustion thereof. Such a possibility of manipulating as required the water content of the mixture makes the handling of the mixture easier, is economically favourable and entails a number of other substantial advantages. If the water content of the mixture is increased by the addition of water, this water should contain dispersing agent such that the concentration of dispersing agent of the mixture will be kept substantially unaltered.

For economical reasons, all the above discussed steps for preparing the final carbon-water mixture are suitably effected at normal ambient temperature. No significant influence of temperature has been established, the sole requirement being however of course that the temperature is above the freezing point of water.

On the other hand, a certain influence of the pH value of the mixture has been established. Generally, the pH value of the mixture may be at about 5–10. However, the addition of alkali to a pH of about 7–10 has turned out to produce a noticeable stabilizing effect on the finished concentrated carbon-water mixture.

What we claim and desire to secure by Letters Patent is:

1. A stabilized coal slurry comprising pulverized and purified coal, water and a dispersing agent, said dispersing agent by selective absorption having produced different charging of particles of coal and particles of other substances to obtain purified coal and maintain the stability of the slurry.

2. Composition as claimed in claim 1, wherein the dispersing agent is a polyelectrolyte.

3. Composition as claimed in claim 2, wherein the polyelectrolyte is a salt of a polycarboxylic acid.

4. Composition as claimed in claim 3, wherein the polyelectrolyte is a polyacrylate.

5. Composition as claimed in claim 3, wherein the polyelectrolyte is an alkali metal or ammonium salt of a polycarboxylic acid.

6. Composition as claimed in claim 5, wherein the polyelectrolyte is sodium polyacrylate.

7. Composition as claimed in claim 1, wherein the dispersing agent is a polyphosphate.

8. Composition as claimed in claim 1, wherein the particle size of the pulverized carbon is less than 100 μm.

9. Composition as claimed in claim 8, wherein the particle size is less than 50 μm.

10. Composition as claimed in claim 9, wherein the particle size is less than 40 μm.

11. Composition as claimed in claim 1, wherein the pulverized carbon amounts to at most about 80% by weight of the mixture.

12. Composition as claimed in claim 11, wherein the carbon amounts to at least about 55% by weight of the mixture.

13. Composition as claimed in claim 1, wherein the dispersing agent amounts to about 0.02–4% by weight of the water.

14. Composition as claimed in claim 13, wherein the dispersing agent amounts to about 0.2–0.8% by weight of the water at a water content of about 30% by weight.

15. Composition as claimed in claim 13, wherein the dispersing agent amounts to about 0.04–0.4% by weight of the water at a water content of about 90% by weight.

16. Composition as claimed in claim 1, wherein it has a pH value of about 7–10.

17. A method for preparing from a carbonaceous starting material which, in addition to coal, also includes impurities, a stabilized coal slurry containing the coal in pulverized purified form, as well as water and a dispersing agent, wherein the carbonaceous starting material is mixed with water, pulverized and, in connection with or subsequent to pulverization, supplied with a dispersing agent by selective adsorption produces different charging of coal particles and impurity particles, and wherein this different charging is utilized in order to separate the coal from the impurities and to stabilize the coal slurry.

18. Method as claimed in claim 17, wherein as dispersing agent there is added a polyelectrolyte.

19. Method as claimed in claim 18, wherein as polyelectrolyte there is added a salt of a polycarboxylic acid.

20. Method as claimed in claim 19, wherein as polyelectrolyte there is added a polyacrylate.

21. Method as claimed in claim 19, wherein as polyelectrolyte there is added an alkali metal or ammonium salt of a polycarboxylic acid.

22. Method as claimed in claim 20, wherein as polyelectrolyte there is added a sodium polyacrylate.

23. Method as claimed in claim 17, wherein as dispersing agent there is added a polyphosphate.

24. Method as claimed in claim 17, wherein the carbonaceous starting material is pulverized to a particle size of less than about 100 μm.

25. Method as claimed in claim 24, wherein the carbonaceous starting material is pulverized to a particle size of less than 50 μm.

26. Method as claimed in claim 25, wherein the carbonaceous starting material is pulverized to a particle size of less than 40 μm.

27. Method as claimed in claim 17, wherein the separation of carbon and impurities is effected by at least one of the methods of sedimentation, separation under the influence of a magnetic field, separation under the influence of an electric field, and flotation.

28. Method as claimed in claim 17, wherein the carbon content prior to separation is at most about 10% by weight and, in connection with the separation or subsequent thereto, is raised to at most about 80% by weight by removal of water.

29. Method as claimed in claim 28, wherein the carbon content is raised to at least about 55% by weight.

30. Method as claimed in claim 17, wherein the dispersing agent is supplied in an amount of about 0.02–4% by weight of the water.

31. Method as claimed in claim 29, wherein the dispersing agent is supplied in an amount of about 0.04–0.4% by weight.

32. Method as claimed in claim 17, wherein the pH value of the composition is adjusted to about 7–10.

* * * * *

Disclaimer 4,217,109.—*Olle Lennart Siwersson,* Helsingborg, *Arne Evert Wall,* Landskrona and *Jan Ake Torsten Loodberg,* Helsingborg, Sweden. COMPOSITION COMPRISING A PULVERIZED PURIFIED SUBSTANCE, WATER AND A DISPERSING AGENT, AND A METHOD FOR PREPARING THE COMPOSITION. Patent dated Aug. 12, 1980. Disclaimer filed Mar. 6, 1986, by the *inventors,* the assignee, *AB Scaniainventor, consenting.*

Hereby enters this disclaimer to claims 1, 2, 8, 10, 11, 12, 16, 17, 18, 25, 26, 27, 28 and 32 of said patent.

[*Official Gazette May 13, 1986.*]